US005575696A

United States Patent [19]

Endo et al.

[11] Patent Number: 5,575,696

[45] Date of Patent: Nov. 19, 1996

[54] TERMINAL RECEPTACLE

[75] Inventors: Takayoshi Endo; Isao Kameyama, both of Shizuoka, Japan

[73] Assignee: Yazaki Corporation, Tokyo, Japan

[21] Appl. No.: 297,787

[22] Filed: Aug. 30, 1994

[30] Foreign Application Priority Data

Sep. 1, 1993 [JP] Japan ..... 5-047624 U

[51] Int. Cl.[6] ..... H01R 13/11

[52] U.S. Cl. ..... 439/852; 439/854

[58] Field of Search ..... 439/839, 842, 439/843, 844, 845, 849, 851–853, 858, 861, 862

[56] References Cited

U.S. PATENT DOCUMENTS

| | | | |
|---|---|---|---|
| 3,713,080 | 1/1973 | Kennedy | 439/852 |
| 4,593,963 | 6/1986 | Endo et al. | 439/852 |
| 4,699,444 | 10/1987 | Isohata | 439/852 |

*Primary Examiner*—Hien D. Vu

*Attorney, Agent, or Firm*—Armstrong, Westerman, Hattori, McLeland & Naughton

[57] ABSTRACT

An improved metal terminal receptacle with stoppers for protecting an elastic tongue. The metal terminal receptacle includes a base plate; an insertion portion at an end of the base plate including the base plate, two side walls extending from the base plate, and an upper wall integrally formed with the side walls; a supporting portion for pinching a mated male terminal with an inner wall of the insertion portion and a U-shaped elastic tongue, where the elastic tongue extends from one of the side walls and is inserted into the insertion portion; a wire connecting portion at the other end of the base plate; and projections formed by embossing inwardly the opposing walls, adjacent the wall having the elastic tongue, of the insertion portion, wherein a straight-line cutout is provided in each of the opposing walls before the succeeding embossing work. The upper end faces of the projections acting as the stoppers for limiting the deflection of the elastic tongue within a predetermined elastic limit thereof.

3 Claims, 6 Drawing Sheets

TERMINAL RECEPTACLE

BACKGROUND OF THE INVENTION

1. Field of the Invention

The present invention relates to an improvement on a metal terminal receptacle with stoppers for protecting its elastic tongue.

2. Description of the Related Art

FIGS. 4 and 5 respectively show a plan view and a front view of a conventional metal terminal receptacle with stoppers for protecting an included elastic tongue. The metal terminal receptacle A is formed by bending a plate, and an insertion portion A1 is formed at the left side of a base plate 1; a wire connecting portion A2 is formed at the right side.

In order to shape the insertion portion A1, the base plate 1 is bent at an end thereof to form a side wall 2, and the side wall is bent to provide an upper wall 3. Then, the upper wall 3 is further inwardly bent to form another side wall 2. As a result, the base plate 1, the side walls 2 and the upper wall 3 constitute a square case, as clearly illustrated in FIG. 7 which is a left side view of the metal terminal receptacle shown in FIG. 4.

An elastic tongue 4 is bent at an end of one of the side walls 2 and extends therefrom. As illustrated in FIG. 6, the elastic tongue 4 is further folded and is in press-contact with the other wall 12 by its resilience, and a supporting portion is formed between the elastic tongue 4 and the wall 2, where a male terminal is inserted and pinched.

Projections 5 as stoppers for limiting the deflection of the elastic tongue 4 within the elastic limit are provided on the base plate 1 and the upper wall 3. The projections 5 are formed by inwardly punching the plate 1 and the wall 3, for instance, through a press and by bending the punched portion upright. Both ends of the elastic tongue 4 abut the projections 5 to prevent the elastic tongue 4 from deflecting excessively beyond the elastic limit.

In order to decrease the resiliency at the tip of the elastic tongue 4, the width thereof is gradually reduced and a long hole 6 is provided. The wire connecting portion A2 on the right side of the base plate 1 is provided with two supporting portions 7 and 8, respectively, for a wire insulation portion and a conductor wire. However, the construction of the conventional metal terminal receptacle has the following problems.

In the manufacturing process of the metal terminal receptacle A, a punching work portion 10 is attached to an upper face of a lower metal mold 9 of the press, and the side faces of the punching work portion 10 are edged except for an inner side wall 10*a* to form the projections 5 on the base plate 1 and the upper wall 3. Then, the base plate 1 or the upper wall 3 is placed over the lower metal mold 9 as illustrated in FIG. 8A, and then, the upper metal mold 11 descends. As a result, a U-shaped cutout is formed on the base plate 1 and an upper wall 3, and then, a portion enclosed by the U-shaped cutout is inwardly bent so as to be upright to the base plate 1 or the upper wall 3 to form the projection 5 as indicated in FIG. 8B.

There are the following problems when the punching work is carried out. Firstly, burrs are brought about when the U-shaped cutout is formed, and the burrs cause the position of stoppers for limiting the deflection of the elastic tongue 4 to fluctuate. As a result, the elastic tongue 4 may abut the projections 5 even though the elastic deflection is not sufficient, or the elastic deflection of the elastic tongue 4 may become too large. Secondly, the height L of the projection 5 should be more than 1.5 times the plate thickness T to carry out the punching work, which considerably increases the height L of the projection 5. Therefore, as illustrated in FIG. 9, when the elastic tongue 4 is bent under the condition that the insertion portion 4 is being processed, a forming tool 12 for the elastic tongue 4 is interrupted by the projections 5, which makes the manufacturing work of the insertion portion A1 ineffective. Thirdly, the punching work portion 10 should be enlarged to improve the durability of the lower metal mold 9. However, openings 13 made by the punching work become large, resulting in decreased strength of the base plate 1 or the upper wall 3. Further, there is a unfavorable possibility that foreign materials enter the metal terminal receptacle A.

SUMMARY OF THE INVENTION

The present invention has been accomplished to eliminate the above drawbacks of the conventional metal terminal receptacle and it is, therefore, an object of the present invention to provide a metal terminal receptacle in which the stoppers for the elastic tongue 4 are accurately positioned; the projections 5 do not interrupt the bending work; and the strength of the base plate 1 and the upper wall 3 is not reduced.

The metal terminal receptacle according to the present invention comprises: a base plate; an insertion portion position at one end of the base plate including two side walls extending from the base plate, and an upper wall integrally formed with the side walls; an elastic tongue extending from one of the side walls at an end of the insertion portion the elastic tongue having a main body formed in a first U-shaped over the one side wall and having a tip portion bent in a second U-shape into the main body of the tongue; a wire connecting portion at the other end of the base plate; straight-line cutouts formed in the base plate and the upper wall, cutouts being formed parallel to said two side walls, and portions of the base plate and the upper wall adjacent the straight-line cutouts are embossed inwardly to form half-cup shaped projections, wherein the upper end faces of the projections act as stoppers for limiting the deflection of the main body of the elastic tongue within a predetermined elastic limit thereof to improve durability of said elastic tongue.

BRIEF DESCRIPTION OF THE DRAWINGS

The present invention will be more apparent from the ensuring description with reference to the accompanying drawing wherein.

DETAILED DESCRIPTION OF PREFERRED EMBODIMENTS

Figure 1:
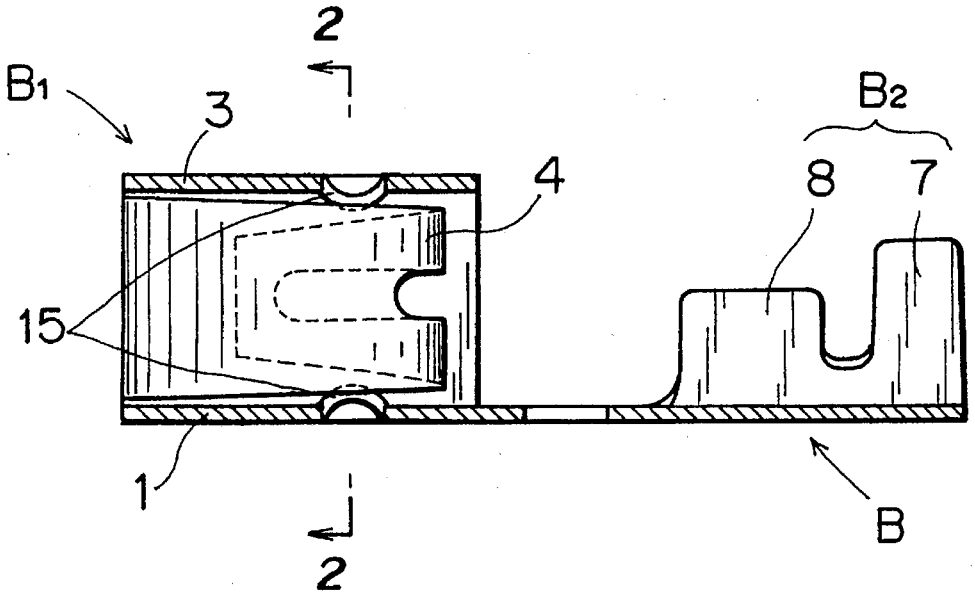
FIG. 1 is a laterally cross-sectional view of a metal terminal receptacle according to the present invention.

A metal terminal receptacle according to an embodiment of the present invention will be explained with reference to drawings.

A metal terminal receptacle B is provided with an insertion portion B1 on the left side of a base plate 1 and a wire connecting portion B2 on the right side. The insertion portion B1 comprises the base plate 1, and two side walls 2 and an upper wall 3 like the conventional metal terminal receptacle.

An elastic tongue 4 is bent at an end of one of the side walls 2 and the main body of the tongue extends therefrom in a first U-shape. The elastic tongue 4 is further folded in a second U-shape and is provided with a long hole at a tip portion thereof. The elastic tongue 4 is in resilient press-contact with the other wall 2, and a supporting portion is formed between the elastic tongue 4 and the wall 2, where a mated male terminal is supported. The wire connecting portion B2 is provided with two supporting portions 7 and 8 for a wire insulating portion and a conductor wire in the same manner as the conventional metal terminal receptacle.

Figure 2:
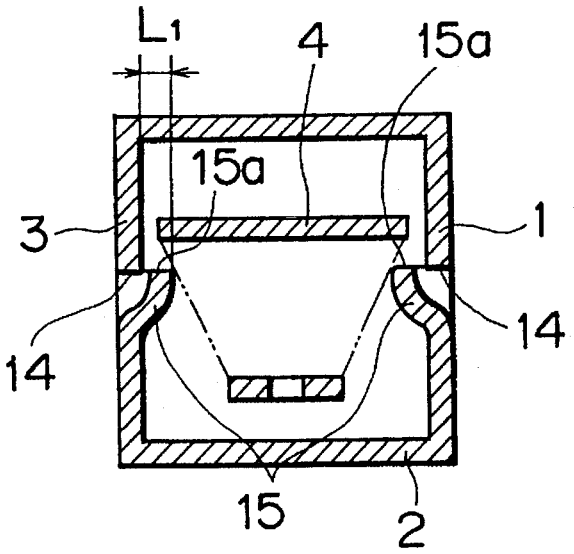
FIG. 2 is a cross-sectional view taken along the line 2—2 in FIG. 1.

However, in the metal terminal receptacle B according to the present invention, straight-line cutouts 14 substantially parallel to the side walls 2 are formed on the base plate 1 and the upper wall 3 which oppose each other with the one side wall having the elastic tongue 4 in between. Further, portions on the base plate 1 and the upper wall 3 adjacent the straight-line cutouts are inwardly embossed to form projections 15 as indicated in FIG. 2. Unlike the U-shaped portions in the conventional metal terminal receptacle, the straight-line cutouts and the projections 15 are easily formed due to their simplicity in shape without excessive force. As a result, large burrs are less likely generated in this invention.

Figure 3:
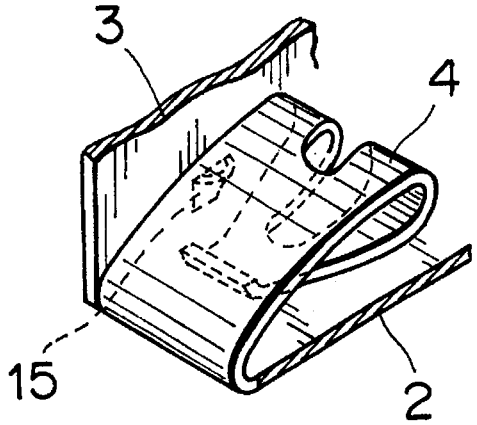
FIG. 3 is a perspective view for explaining the relationship between projections and an elastic tongue of the metal terminal receptacle according to the present invention.
Figure 4:
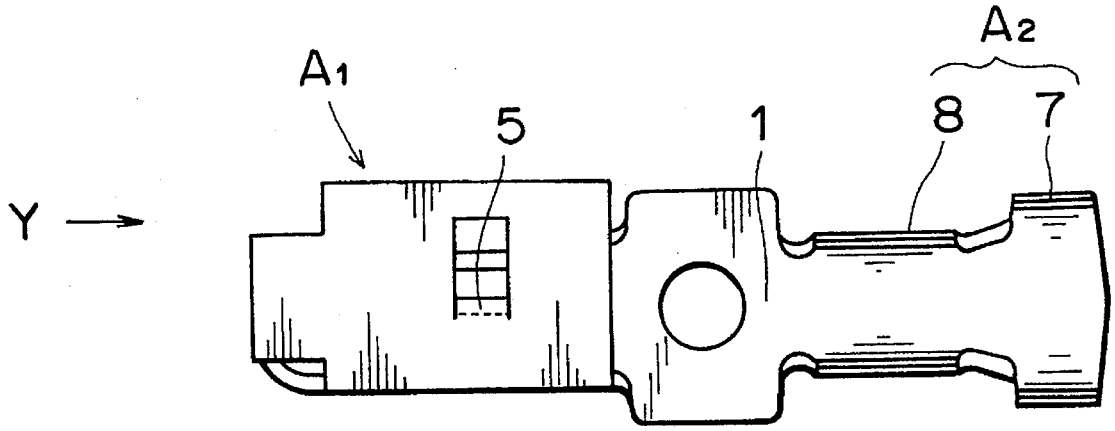
FIG. 4 PRIOR ART
FIG. 4 is a plan view of a conventional metal terminal receptacle.
Figure 5:
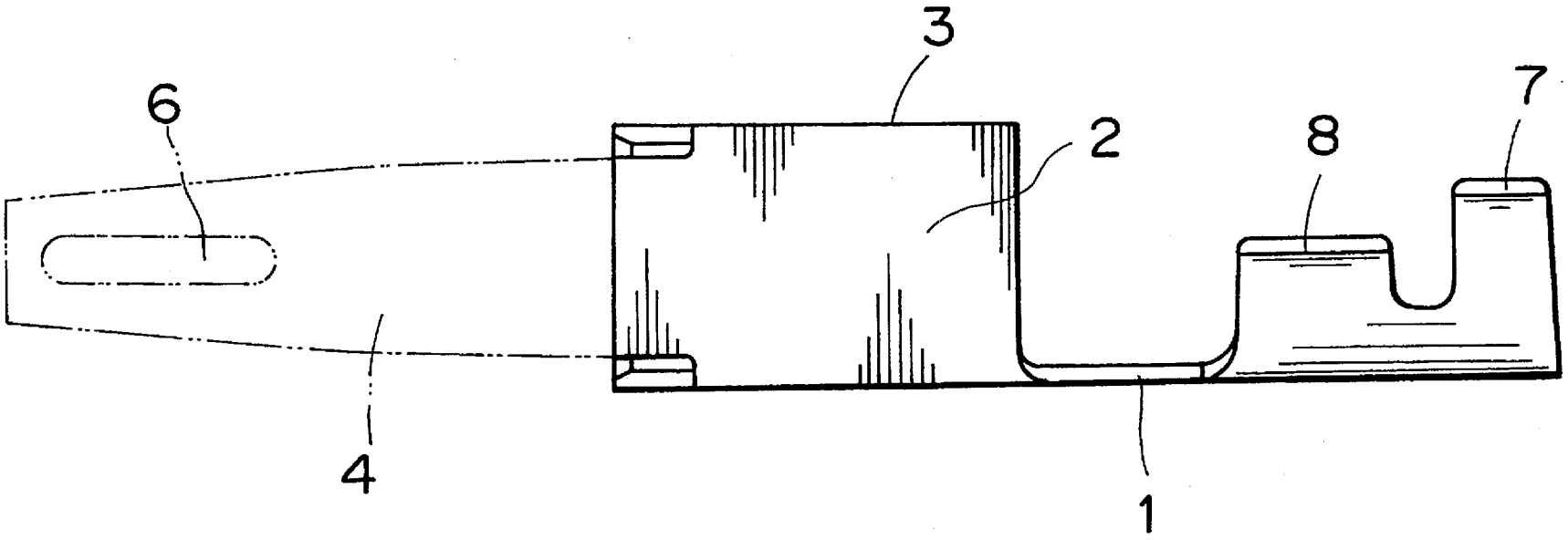
FIG. 5 PRIOR ART
FIG. 5 is a front view of the conventional metal terminal receptacle in FIG. 4.
Figure 6:
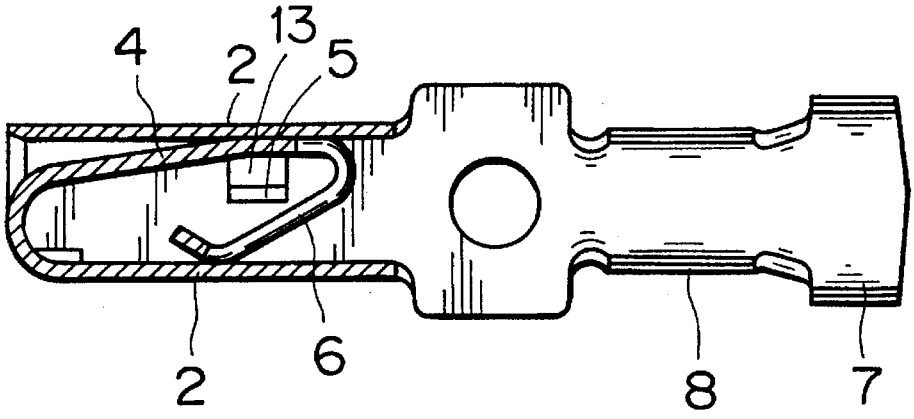
FIG. 6 PRIOR ART
FIG. 6 is a partially fragmented plan view of the conventional metal terminal receptacle.
Figure 7:
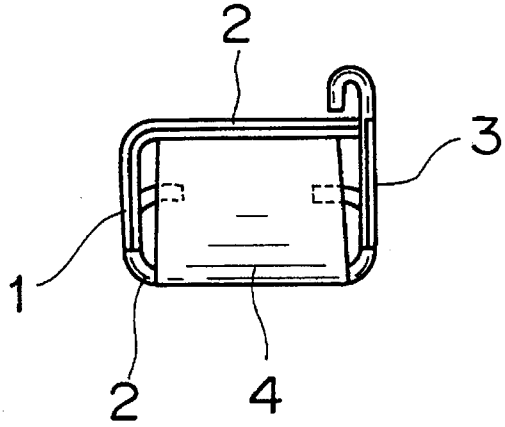
FIG. 7 PRIOR ART
FIG. 7 is a left side view of the metal terminal receptacle shown in FIG. 4.
Figure 8A:
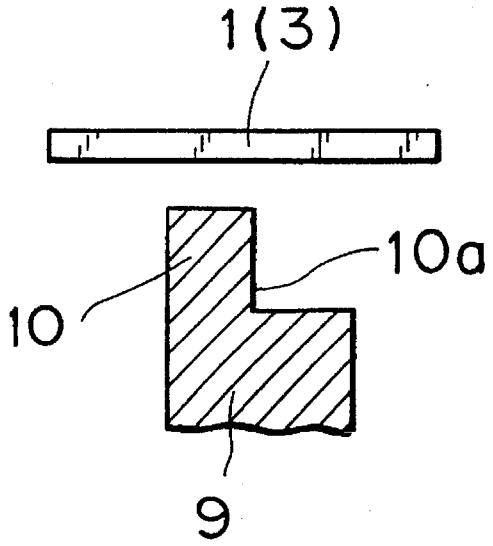
FIGS. 8A and 8B are schematic drawings for explaining the process of the punching work.
Figure 8B:
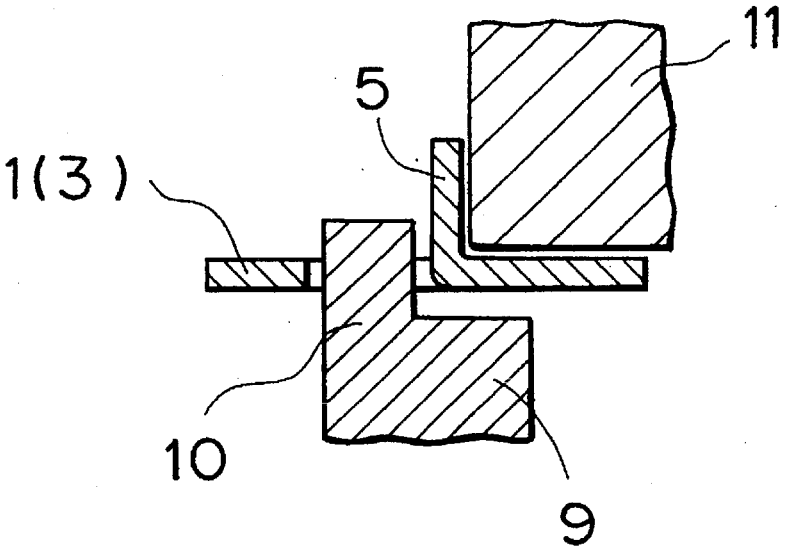
Figure 9:
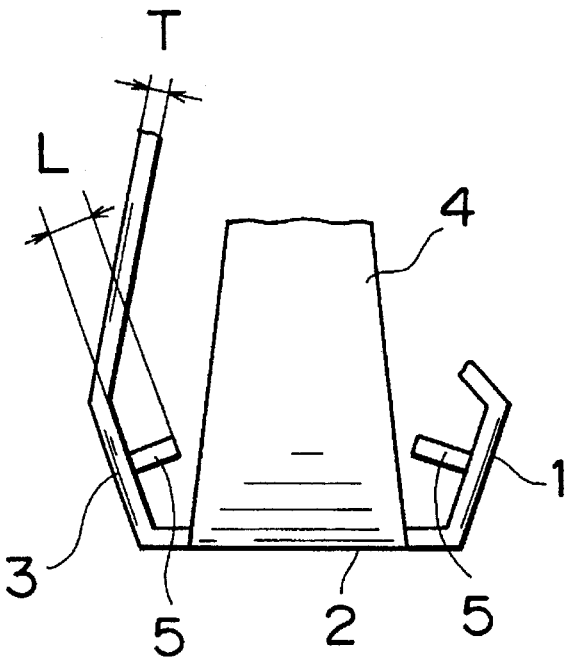
FIG. 9 is a drawing for explaining the process of bending the elastic tongue when observed from the reference symbol side Y in FIG. 4.
Figure 10:
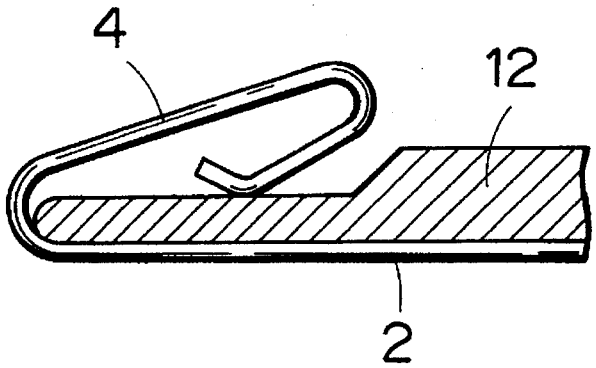
FIG. 10 is a drawing for explaining the bending work with a forming tool for the elastic tongue.

The embossing work for the projections 15 is easily carried out by utilizing the straight-line cutouts 14 and the height L1 of the projections 15 is determined regardless of the plate thickness, unlike the conventional metal terminal receptacle. Therefore, the widths of both ends of the tongue 4 are selected within a range where the main body the tongue 47 abuts the projections 15 as illustrated in FIGS. 2 and 3, and the height L1 is determined so that movement of the tongue 4 is not limited by the projections when forming tool 12 is inserted. As a result, the manufacturing process for the metal terminal receptacle is simplified and the manufacturing cost thereof can be reduced.

Upper ends faces 15*a* of the projections 15 functioning as stoppers for the elastic tongue 14 are normal flush with the straight-line cutouts 14, thereby preventing the variability observed in positions of the punched projections in the conventional metal terminal receptacle. Further, few burrs are generated on the stoppers so that the main body of the elastic deflection of the elastic tongue 4 at the abutment with the upper end faces 15*a* is maintained at a prescribed setting value within the elastic range, resulting in improved durability of the elastic tongue 4.

Since the upper ends 15*a* of the projections 15 are flush with the straight-line cutouts 4, no foreign materials enter into the metal terminal receptacle. A metal mold used for forming the straight-line cutouts 14 and embossing the projections 15 is simple in construction in comparison to the metal mold used for the punching work for the conventional metal terminal receptacle, and an excessive load is not applied to the metal mold in this invention, which increases the life of the metal mold.

With the construction of the metal terminal receptacle according to the present invention, the following effects are obtained. Firstly, the upper ends of the projections as stoppers for the elastic tongue are accurately positioned, so that the deflection of the elastic tongue is maintained at a prescribed value. Secondly, the height of the projections is freely determined as long as the projections abut the elastic tongue, which eliminates the problem of the interruption with the forming tool for the elastic tongue. As a result, the metal terminal receptacle is easily manufactured with high efficiency, resulting in decreased manufacturing cost. Thirdly, the durability of the metal mold is improved and foreign material does not enter the metal terminal receptacle in the present invention.

What is claimed is:

1. A metal terminal receptacle comprising:

a base plate;

an insertion portion positioned at one end of the base plate and including two side walls extending from the base plate, and an upper wall integrally formed with the side walls;

an elastic tongue extending from one of the side walls at an end of the insertion portion, said elastic tongue having a main body formed in a first U-shape over said one sidewall and having a tip portion thereof bent in a second U-shape into said main body of said elastic tongue;

a wire connecting portion at the other end of the base plate; and straight-line cutouts formed in the base plate and the upper wall, the cutouts being formed parallel to said two sidewalls, portions of the base plate and the upper wall adjacent the straight-line cutouts are embossed inwardly to form half-cupped shaped projections, wherein upper end faces of the projections being formed flush with the straight-line cutouts act as stoppers for limiting the deflection of the main body of the elastic tongue within a predetermined elastic limit thereof to improve durability of said elastic tongue.

2. The metal terminal receptacle according to claim 1 wherein the tip portion of the elastic tongue has a width which is less than a distance between both the projections.

3. The metal terminal receptacle according to claim 1 wherein a top portion of the elastic tongue has an opening in a middle portion thereof.

* * * * *